US005786765A

United States Patent [19]

Kumakura et al.

[11] Patent Number: 5,786,765

[45] Date of Patent: Jul. 28, 1998

[54] APPARATUS FOR ESTIMATING THE DROWSINESS LEVEL OF A VEHICLE DRIVER

[75] Inventors: Sae Kumakura; Toru Hara, both of Okazaki; Yoshihiro Goi, Anjo, all of Japan

[73] Assignee: Mitsubishi Jidosha Kogyo Kabushiki Kaisha, Tokyo, Japan

[21] Appl. No.: 840,132

[22] Filed: Apr. 11, 1997

[30] Foreign Application Priority Data

Apr. 12, 1996 [JP] Japan ..... 8-091324

[51] Int. Cl.[6] ..... G08B 23/00

[52] U.S. Cl. ..... 340/576; 340/575; 600/558; 351/211

[58] Field of Search ..... 340/576, 575; 600/558, 544, 545; 180/272, 273; 351/211, 221

[56] References Cited

U.S. PATENT DOCUMENTS

| | | | |
|---|---|---|---|
| 4,397,531 | 8/1983 | Lees | 351/210 |
| 4,725,824 | 2/1988 | Yoshioka | 340/575 |
| 4,953,111 | 8/1990 | Yamamoto et al. | 364/569 |
| 5,311,877 | 5/1994 | Kishi | 600/545 |
| 5,570,698 | 11/1996 | Liang et al. | 600/558 |
| 5,573,006 | 11/1996 | Shimotani et al. | 600/558 |
| 5,689,241 | 11/1997 | Clarke, Sr. et al. | 340/575 |

FOREIGN PATENT DOCUMENTS

| | | |
|---|---|---|
| 61-175129A | 8/1986 | Japan . |
| 6270711A | 9/1994 | Japan . |
| 7156682A | 6/1995 | Japan . |

*Primary Examiner*—Jeffery A. Hofsass
*Assistant Examiner*—Benjamin C. Lee

[57] ABSTRACT

An apparatus for estimating a drowsiness level of a vehicle driver first prepares a frequency distribution of blink durations of the driver for a first predetermined period after the start of a driving operation, and sets a threshold value for a discrimination of slow blinks by the frequency distribution. Thereafter, the apparatus calculates, every second predetermined period, a ratio of the number of slow blinks to the total number of blinks of the driver's eyes during the second period, and discriminates a rise in the drowsiness level of the driver in accordance with the calculated ratio.

13 Claims, 5 Drawing Sheets

APPARATUS FOR ESTIMATING THE DROWSINESS LEVEL OF A VEHICLE DRIVER

BACKGROUND OF THE INVENTION

1. Field of the Invention

The present invention relates to an apparatus for estimating the drowsiness level of a vehicle driver in accordance with the driver's blinking.

2. Description of the Related Art

Recently, there have been developed various apparatuses that estimate the drowsiness level of a car driver and give an alarm when the drowsiness level rises. These apparatuses enable the driver to maintain the necessary power of attention for safe driving. The principle of an apparatus for estimating the drowsiness level is based on blinks of the driver's eyes. For example, an apparatus described in Jpn. Pat. Appln. KOKAI Publication No. 61-175129 counts number blinks of the driver's eyes for each unit time, and discriminates a rise in the drowsiness level of the driver by the result of the counting. An apparatus described in Jpn. Pat. Appln. KOKAI Publication No. 6-270711 detects a change in the shape of the driver's pupillary regions, and estimates the drowsiness level of the driver in accordance with the eye blink duration and the frequency of blinking associated with the change. The eye blink duration is defined by the time interval between the start and termination of each eye blink. An apparatus disclosed in Jpn. Pat. Appln. KOKAI Publication No. 7-156682 estimates the drowsiness level of the driver from the integrated value of blink durations of the driver for each unit time.

There are differences in the blink duration and the frequency of blinking among each individual. In many cases, moreover, the blink duration and the frequency of blinking of one individual continually change without regard to drowsiness level of the individual. Accordingly, it is difficult to accurately discriminate the individual's drowsiness level from the result of simple comparison between preset reference values and the blink frequency, i.e., the number of blinks per unit time, and/or the blink duration. In other words, the blink duration and the frequency of blinking themselves are subject to substantial differences between individuals and vary at all times. If they are compared with the reference values that are set unitarily, therefore, the drowsiness level of the driver cannot be estimated with satisfactory accuracy.

SUMMARY OF THE INVENTION

The object of the present invention is to provide an apparatus capable of accurately estimating and discriminating the drowsiness level of a driver in accordance with a blink duration of a driver's eye after absorbing differences in the way of blinking between individuals.

The above object is achieved by an estimating apparatus according to the present invention, which comprises: image pickup means for picking up images of a face region of a driver of a vehicle including an eye of the driver; detecting means for detecting an elapsed time during one blink of the eye as a blink duration in accordance with image data for the face region obtained by the image pickup means; obtaining means for obtaining the frequency distribution of blink duration detected during a first predetermined period after the start of driving of the vehicle; setting means for setting a threshold value used to extract slow blinks of the eye in accordance with the frequency distribution; calculating means for calculating a ratio of occurrence of the slow blinks during every second predetermined period after a termination of the first predetermined period, the ratio of occurrence being represented by the ratio of the number of blink durations whose values are not smaller than the threshold value to a total number of blinks of the eye during the second predetermined period; and discriminating means for discriminating the drowsiness level of the driver in accordance with the calculated ratio of occurrence.

According to the estimating apparatus of the invention described above, the frequency distribution of blink durations of the driver himself is first obtained during the first predetermined period in the initial stage of driving operation, and the threshold value for the discrimination of slow blink is set in accordance with this frequency distribution. Therefore, the threshold value set in this manner cannot be influenced by differences among individuals, and is peculiar to the driver. Thus, the ratio of occurrence of slow blinks obtained as a result of comparison between the threshold value and the blink duration of the driver exactly represents the drowsiness level of the driver himself. Preferably, in this case, the first predetermined period should be longer enough than the second predetermined period.

Since the threshold value is updated every time the driver starts driving, moreover, it cannot be influenced by the driver's physical condition.

Specifically, the setting means for setting the threshold value may include means for obtaining a normal range of the blink durations from the frequency distribution, means for calculating a median in the normal range, and means for outputting, as the threshold value, a value obtained by adding a predetermined time set in accordance with the normal range to the median. In this case, the threshold value is set in accordance with the normal range of blinking of the driver, so that slow blinks of the driver's eye can be detected more accurately.

More specifically, the normal range may be defined as the difference between two blink durations with a reference frequency in the frequency distribution of blink durations. In this case, the reference frequency is obtained by multiplying the mode of the frequency distribution by a first predetermined ratio. Moreover, the predetermined time added to the median may be defined as a value obtained by multiplying the time length of the normal range by a second predetermined ratio.

The means for discriminating the drowsiness level of the driver may include a discriminating section for outputting the result of the calculation when the calculated occurrence ratio is not lower than a predetermined decision value, and alarm means for giving an alarm to the driver upon receiving the result output from the discriminating section. When the drowsiness level of the driver rises, in this case, the driver can be awakened by the alarm and enabled to drive the vehicle safely.

The estimating apparatus may further comprise display means for displaying the calculated occurrence ratio. In this case, the driver can recognize his own drowsiness level before he is alarmed.

The detecting means for detecting the blink duration may include a storage means for successively storing the image data obtained from the image pickup means, and an image processing section for extracting a region including the driver's eye from the image data in the storage means on a time-series basis, individually specifying the times of a starting of an eye blink and a termination of the eye blink from the extracted data, respectively, and detecting the time interval between the starting and termination times as the blink duration.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
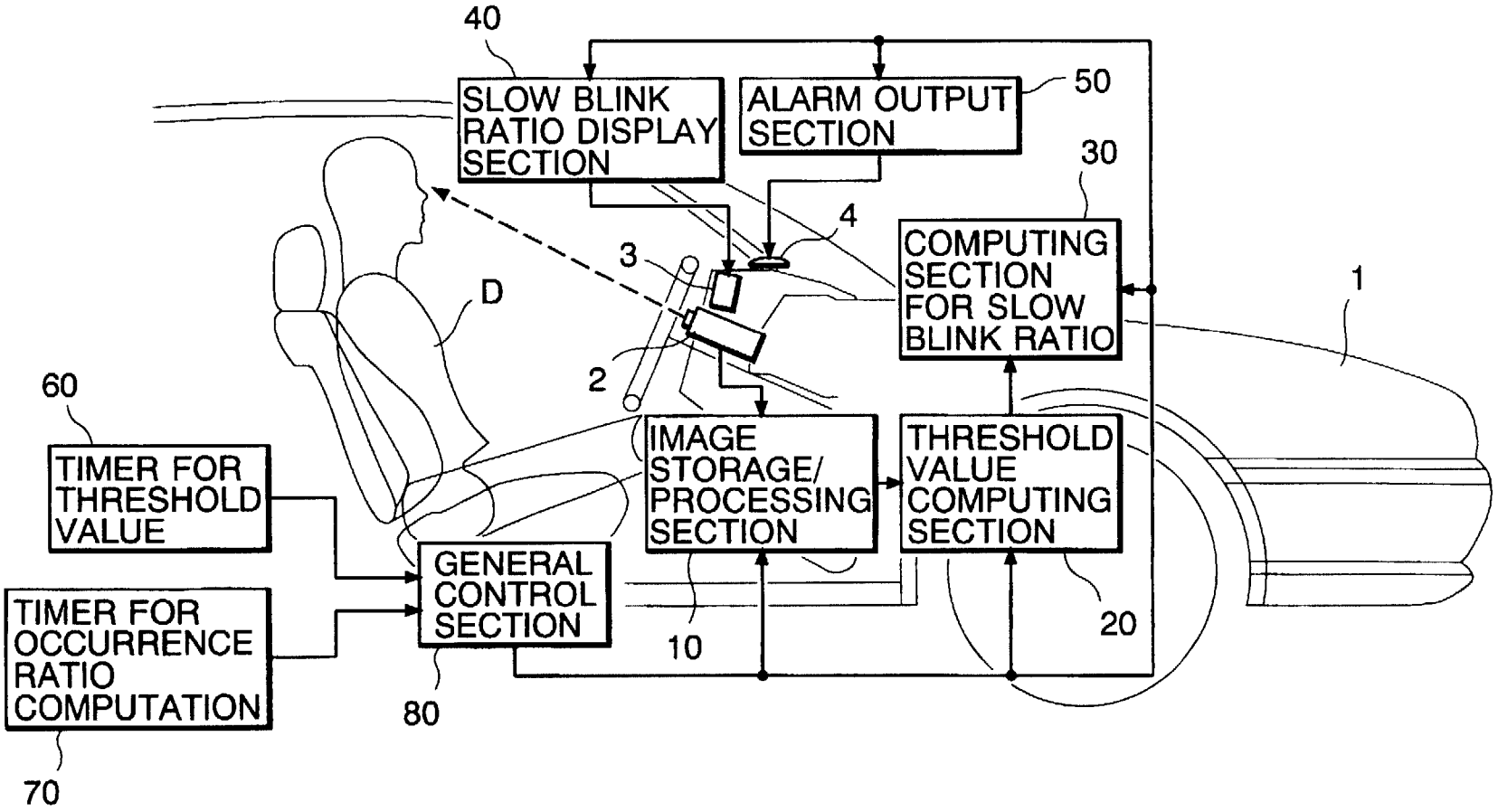
FIG. 1 is a view conceptually showing an arrangement of an estimating apparatus according to one embodiment of the present invention.

Referring to FIG. 1, there is schematically shown an apparatus for estimating the drowsiness level of a driver D, along with a vehicle 1. The estimating apparatus comprises a TV camera 2, a display device 3, and a speaker 4, which are incorporated in an instrument panel at a driver's seat of the vehicle, for example. The TV camera 2 shoots the face of the driver D, especially in the eye regions, and the display unit (multiplex information display device) 3 presents the driver D with images indicative of various pieces of information. The speaker 4 outputs voice messages, alarms, etc.

The estimating apparatus first picks up images of the driver's face by means of the TV camera 2, and detects blinks of the eyes of the driver D from the face images. Then, the estimating apparatus estimates the drowsiness level of the driver D from the required time for each detected blink, that is, blink duration. If it is concluded from this estimation result that the drowsiness level of the driver D is risen, the display device 3 of the apparatus displays a message to that effect, while the speaker 4 sounds an alarm, thereby arousing the driver's attention.

As shown in FIG. 1, the estimating apparatus comprises an image storage/processing section 10, a section 20 for computing the normal blink duration of the driver D as a threshold value, and a section 30 for computing the frequency of blinks having durations longer than the normal blink duration, that is, the ratio of occurrence of slow blinks. The estimating apparatus further comprises a section 40 for displaying the occurrence ratio, a section 50 for outputting alarms, and a control section 80 for controlling the general operations of the sections 10, 20, 30, 40 and 50 by using timers 60 and 70. Each of these sections is formed of an electronic control unit (ECU) including a microprocessor, for example.

Figure 2:
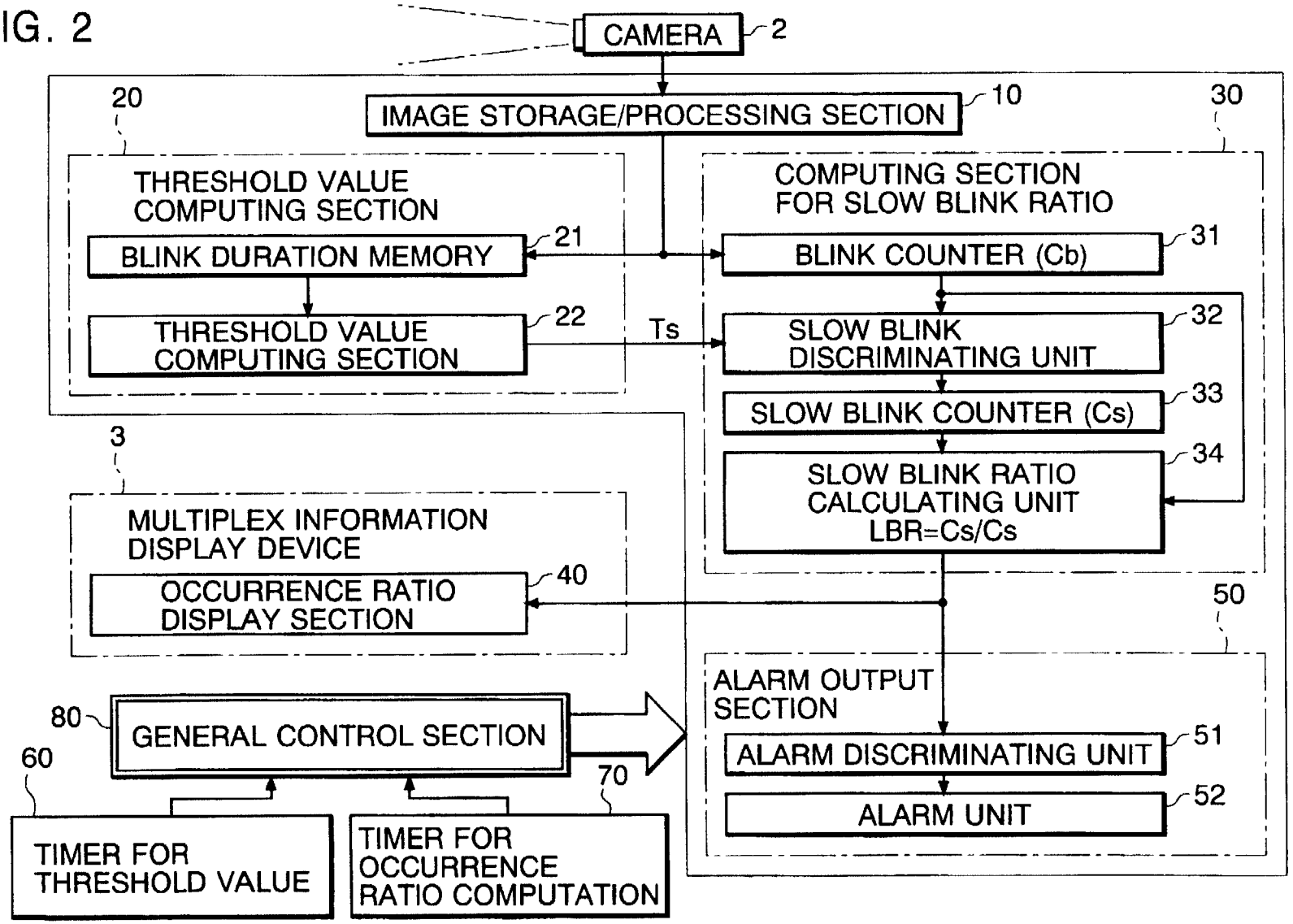
FIG. 2 is a block diagram showing a functional arrangement of the estimating apparatus of FIG. 1.

Referring to the functional block diagram of FIG. 2, there is shown a more specific arrangement of the estimating apparatus. The face images of the driver D picked up by the TV camera 2 are applied to the input of the image storage/processing section 10.

The image storage/processing section 10 includes a storage device for successively storing the input images and an image processing unit for processing data for the input images stored in the storage device. More specifically, the image storage/processing unit 10 first extracts time-series data for regions including the driver's eyes from the input images, and detects the movement (closing and opening) of the driver's eyelids, that is, blinks of the driver's eyes, from the extracted data. Every time the driver D blinks, the image storage/processing unit 10 detects the time interval that elapses from the instant that the driver's eyelids are closed until they are completely opened, that is, the blink duration for each blink. The blink duration detected in this manner is delivered from the image storage/processing section 10 to the section 20 for computing a normal blink duration of the driver.

The computing section 20 includes a memory 21 and a calculating unit 22. The memory 21 is stored successively with blink durations delivered from the image storage/processing section 10 for a predetermined initial driving period after the start of the driver's vehicle driving. The calculating unit 22 obtains the frequency distribution of the blink durations from the data stored in the memory 21, and in accordance with this frequency distribution, determines the normal blink duration and sets a threshold value for determining whether or not a blink duration, that is, the driver's blink, is long.

The computing section 30 for computing the ratio of occurrence of slow blinks includes counters 31 and 33, a discriminating unit 32, and a calculating unit 34. The counter 31 reckons outputted blink durations from the image storage/processing section 10, that is, the total number of blinks (Cb) made by the driver D during a predetermined period.

In the discriminating unit 32, the blink durations delivered from the image storage/processing section 10 and the preset threshold value are compared. Based on the result of this comparison, detection signals are outputted only when the values of the blink durations are larger than the threshold value. The next counter 33 reckons the number of outputted detection signals (Cs) from the discriminating unit 32. Based on the results of counting in the counters 31 and 33, a ratio of occurrence LBR (=Cs/Cb) of the output signals (Cs) to the total number of blinks (Cb) is calculated. The occurrence ratio LBR is delivered from the computing section 30 (calculating unit 34) to the display control section 40 of the display device 3 and the alarm output section 50. The display control section 40 causes the occurrence ratio LBR to be displayed in the formed of, for example, a bar graph on the screen of the display device 3.

The alarm output section 50 includes a discriminating unit 51 and an alarm unit 52. The discriminating unit 51 is used to estimate the drowsiness level of the driver D in accordance with the occurrence ratio LBR and determines whether or not the drowsiness level is increased. If it is concluded by the discriminating unit 51 that the drowsiness level of the driver D is increased, the alarm unit 52 causes the speaker 4 to output an alarm sound or voice message to arouse the driver's attention.

The foregoing computing section 20 sets the threshold value on the basis of the normal blink duration of the driver D in the following manner.

Figure 3:
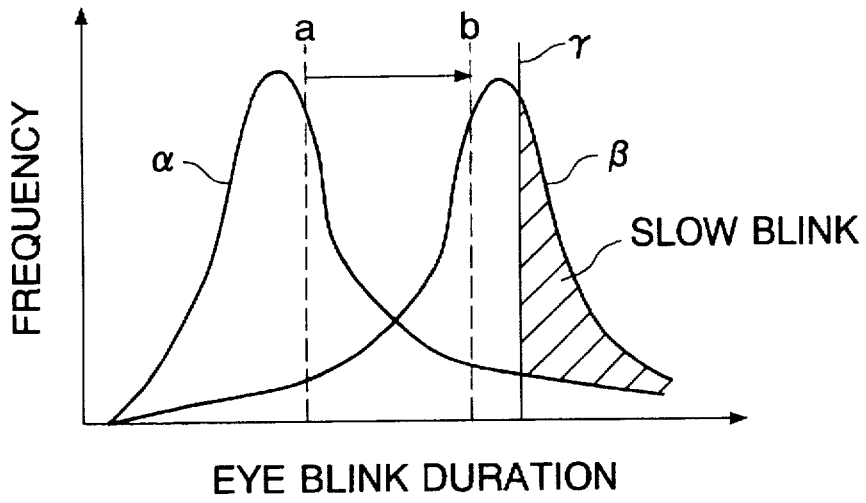
FIG. 3 is a graph showing frequency distributions of blink durations obtained with high and low drowsiness levels.

Before explaining the way of setting the threshold value, the basic technical concept of the present invention will be described first. There are differences in blink duration between individuals. However, the inventors hereof took notice of a general tendency for the blink duration to lengthen as the drowsiness level of a blinker becomes higher. Referring to FIG. 3, there are shown a frequency distribution α of blink durations of a less drowsy blinker and a frequency distribution β of blink durations of a drowsier blinker. As seen from FIG. 3, the frequency distribution α concentrates on a shorter-duration range, and the frequency distribution β on a longer-duration range. This indicates that the normal blink duration (frequency average) changes from a to b of FIG. 3 as the blinker's drowsiness level rises. It is to be understood that the configuration of the frequency distribution itself also changes, in general.

Accordingly, a certain time represented by γ, for example, in the frequency distribution β of FIG. 3 may be set unitarily as a threshold value. If the value of the blink duration of a certain blinker is larger than the threshold value, in this case, then it can be concluded that the drowsiness level of the blinker is high. Generally, however, there are substantial differences between individuals in the configuration of the frequency distribution of blink durations and the process of change from the frequency distribution α into the distribution β. It is not easy, therefore, to determine accurately by the aforesaid threshold value whether or not the extension of the blink duration is attributable to the rise of the drowsiness level. In other words, a threshold value for the discrimination of the rise of the individual's drowsiness level should be set in accordance with the frequency distribution a of low-drowsiness blink durations.

At the start of driving of the vehicle 1, the driver D is supposed to be awake enough. In the initial stage of the driving operation, the driver D is highly conscious of his starting or having started the operation, so that his drowsiness level is low enough. Owing to the monotony of the driving operation or habituation to it or fatigue, however, the driver D cannot be kept highly awake as in the initial driving period. It can be believed, therefore, that the drowsiness level of the driver D rises as the driving time lengthens.

Thus, if the blinking characteristic of the driver D at the start of the driving operation, that is, the normal blink duration peculiar to the driver, can be examined, the threshold value for the decision on the rise of the drowsiness level of the driver can be accurately set in accordance with the normal blink duration. The threshold value, set in this manner, cannot be influenced by differences between individuals.

Figure 4:
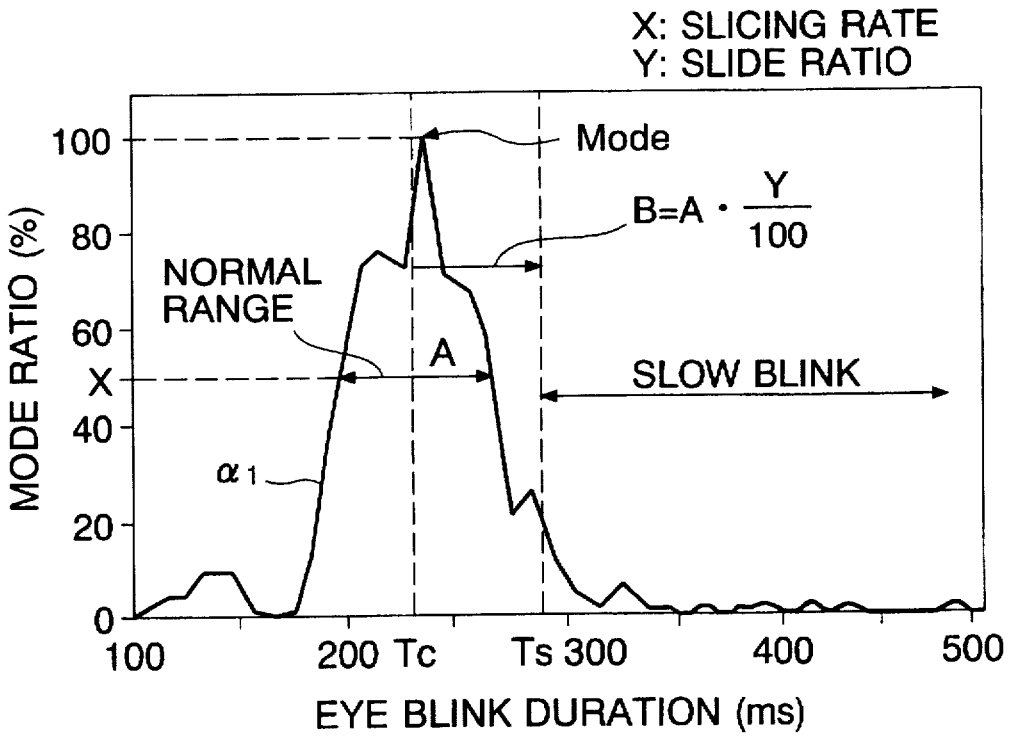
FIG. 4 is a graph showing the relation between a frequency distribution of blink durations of a driver in the initial stage of driving operation and a threshold value Ts set in accordance with this frequency distribution.

Referring to FIG. 4, there is shown a frequency distribution α1 of blink durations of a highly awake individual. It is to be understood that the normal blink duration obtained from the frequency distribution α1 is shorter enough than the low-drowsiness blink durations.

The threshold value used for the decision on the rise of the drowsiness level can be set in accordance with the frequency distribution α1 in the following manner.

In the foregoing computing section 20, the peak value or mode of the frequency distribution α1 of FIG. 4 is first extracted. Then, a normal range is obtained by slicing the frequency distribution α1 at X % of the mode. "X % is defined as a "slicing rate". A time length A for the normal range is equivalent to the individual's normal blink duration range in the initial stage of the driving operation, and is peculiar to the individual.

Then, in the computing section 20, the median in the normal range or time length A is computed as a reference blink duration Tc, and a value obtained by adding a predetermined time B to the reference duration Tc, that is, a value obtained by sliding the reference duration Tc in the increasing direction by a predetermined time, is set as a threshold value Ts. This threshold value Ts is finally used in determining the rise of the drowsiness level. The predetermined time B is set at Y % of the time length A. "Y % is defined as a "slide ratio". Accordingly, the threshold value Ts is computed according to the following equation.

$$Ts=Tc+A\cdot Y/100.$$

Figure 5:
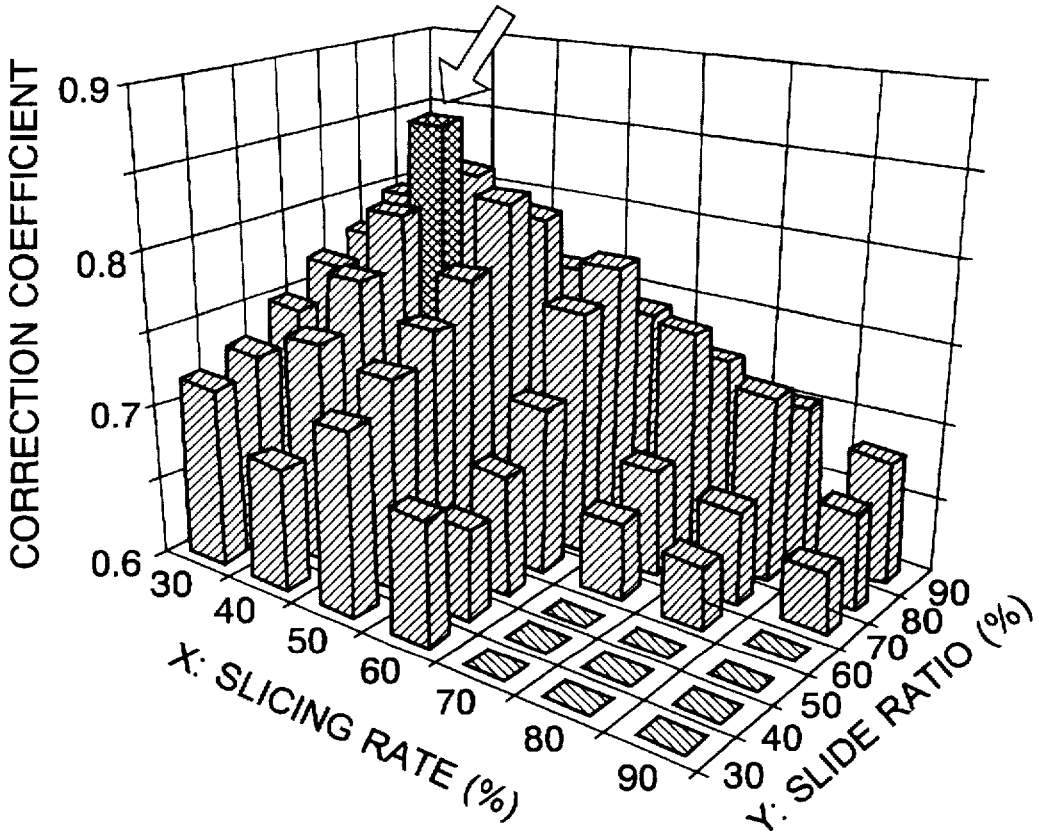
FIG. 5 is a graph showing correlations between simulation results and actual drowsiness levels obtained with use of a slicing rate (X %) and slide ratio (Y %), as parameters, for setting the threshold value.

Referring to FIG. 5, correlations between simulation results of decision on the rise of the drowsiness level using the threshold value Ts and actual results of decision on the rise of the drowsiness level obtained from the facial expression are represented with use of the aforesaid slicing rate (X %) and slide ratio (Y %) as parameters. As seen from FIG. 5, the coefficient of correlation between the simulation results and the actual results takes its maximum value when the slicing rate and slide ratio are 40% and 70%, respectively. While the test results of FIG. 5 indicate average values for a plurality of samples (drivers), it is confirmed that test results for the individual samples have the same tendency as the test results of FIG. 5. With respect to the test results of each individual sample, the coefficient of correlation between the simulation results and the actual results is the highest when the slicing rate and slide ratio are at or near the aforesaid values.

Figure 6:
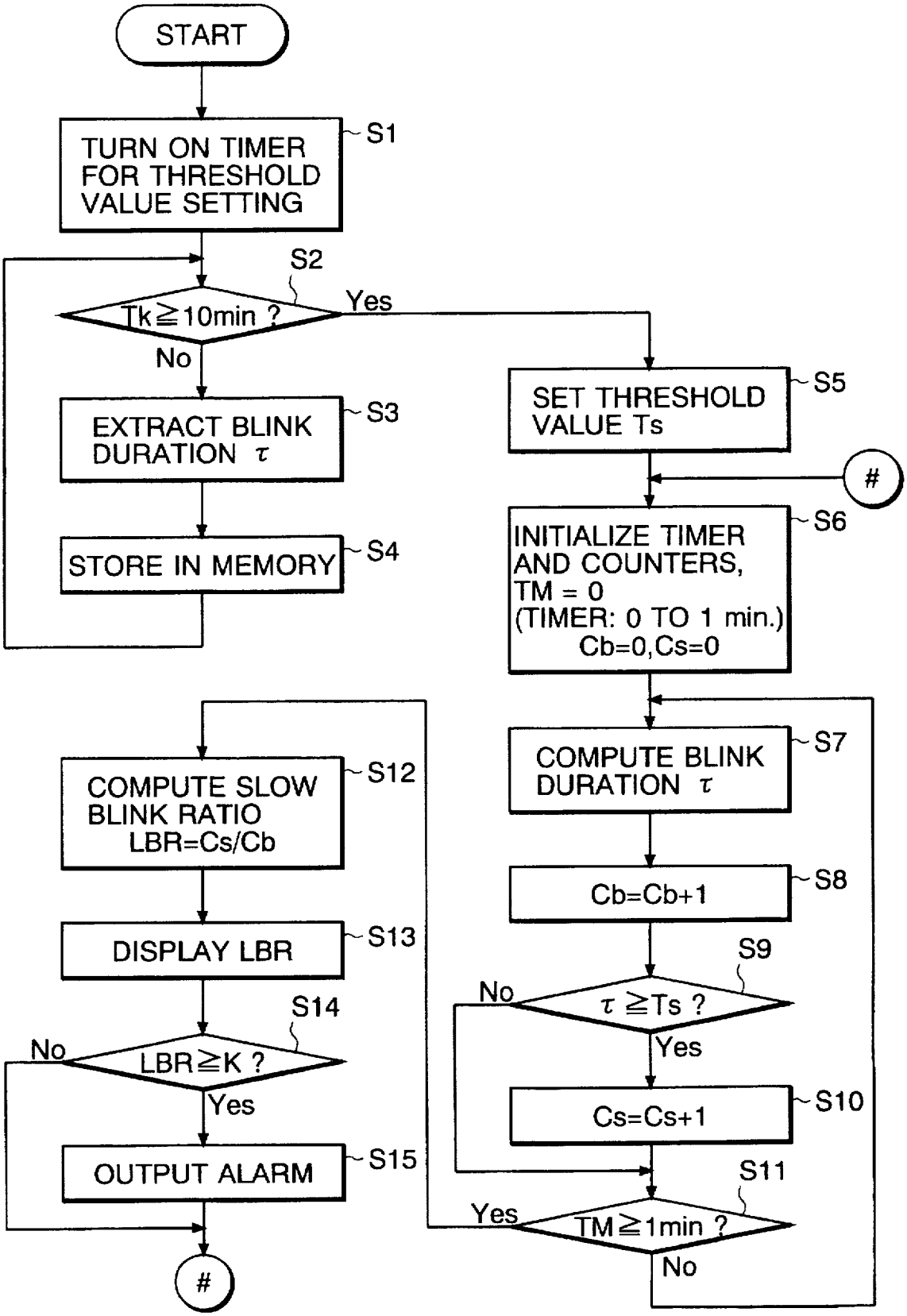
FIG. 6 is a flowchart showing a series of procedures for estimating the drowsiness level of the driver.

In consideration of these circumstances, according to the present invention, the drowsiness level of the driver D is estimated on the basis of the driver's blink duration and the threshold value Ts by means of the aforementioned estimating apparatus. More specifically, the drowsiness level of the driver D is estimated according to the procedures shown in FIG. 6.

First, the general control section 80 activates the timer 60 the moment the driving is started. The timer 60 measures a driving time Tk elapsed after the start of the driving operation (Step S1). Steps S3 and S4 are repeatedly carried out until the conclusion in Step S2 becomes Yes during the time measurement by means of the timer 60, that is, for 10 minutes after the start of the driving operation. As this is done, the image storage/processing section 10 computes a blink duration τ of the driver's eyes every time the blink is detected, and the computed blink duration τ is successively stored into the memory 21 of the computing section 20. Thus, the memory 21 collect data for the blink durations τ within 10 minutes after the start of the driving operation. The data collection for the blink durations τ may be controlled in accordance with the number of blinks in place of the elapsed driving time. For example, the blink durations τ may be collected until the driver D blinks 100 times after the start of the driving operation. Thus, the data collection for the blink durations τ may be controlled either by time or according to the number of blinks.

When the conclusion in Step S2 becomes Yes, the calculating unit 22 of the computing section 20 is activated. The calculating unit 22 obtains the frequency distribution of the blink durations τ from the data stored in the memory 21. This frequency distribution represents the distribution of the frequency of the blink durations obtained when the driver D is highly awake at the start of the driving operation. In the calculating unit 22, thereafter, the aforesaid threshold value Ts is set in accordance with the frequency distribution of the blink durations (Step S5). This threshold value Ts is computed according to the aforementioned equation after the normal-range or time length A and the reference blink duration Tc are computed in accordance with the frequency distribution of the blink durations.

When the threshold value Ts for the blink durations τ is set in this manner, the computing section 30 is then activated. In this computing section 30, values in the timer 70 and the counters 31 and 33 are first initialized, whereupon the timer 70 starts to measure the elapsed time (Step S6).

In the image storage/processing section 10, blinking of the driver D is monitored in the aforementioned manner. When the driver D blinks, the current blink duration τ is computed (Step S7), and the value Cb in the counter 31 is incremented by 1 (Step S8).

Thereafter, the current blink duration τ is compared with the threshold value Ts (Step S9). If the comparison indicates that the value of the blink duration τ is not smaller than the threshold value Ts, that is, if the conclusion in Step S9 is Yes, the value Cs in the counter 33 is incremented by 1 (Step S10). If the conclusion in Step S9 is No, on the other hand, Step S10 is skipped, and Step S11, the next step, is carried out.

In Step S11, it is determined whether or not 1 minute or more is reached by a time TM measured by the timer 70. If the conclusion in Step S11 is No, Step S7 and the subsequent steps are carried out repeatedly.

When the conclusion in Step S11 becomes Yes, therefore, the value Cb in the counter 31 indicates the total number of blinks made by the driver D before the measured time TM reaches 1 minute, while the value Cs in the counter 33 indicates the number of blink durations τ (or number of slow blinks) whose values, among those of all other blink durations, are not smaller than the threshold value Ts. Also in this case, the number of slow blinks Cs observed before 100 is reached by the total number of blinks Cb may be reckoned in place of the measured time TM.

Thereafter, the calculating unit 34 is activated, and the ratio LBR of the number of slow blinks Cb to the total number of blinks Cb is calculated (Step S12). The calculated ratio LBR is processed into a bar graph in the display control section 40, and is then displayed on the display device 3 (Step S13).

Then, the discriminating unit 51 of the alarm output section 50 compares the ratio LBR with a predetermined decision level K (Step S14). If this comparison indicates that the ratio LBR is not lower than the decision level K, that is, if the conclusion in Step S14 is Yes and it is concluded that the frequency of slow blinks or the drowsiness level of the driver D is high, the alarm unit 52 outputs an alarm (Step S15). This alarm is not limited to an alarm sound or voice message from the speaker 4, and may be an alarm message displayed in place of the bar graph for the ratio LBR on the display device 3. In this case, the alarm message visually stimulates the driver D to be more conscious of his or her driving the vehicle.

The processes of Steps S6 to S15 are carried out repeatedly under the control of the timer 70. More specifically, the ratio LBR is obtained for each given time TM, displayed in the form of a bar graph, and at the same time, determined. Based on the result of this determination, an alarm is given immediately when a rise in the drowsiness level of the driver D is detected.

According to the estimating apparatus of the present invention, as described above, the threshold value Ts is set in accordance with the frequency distribution of blink durations of the driver D obtained at the start of the driving operation. With use of this threshold value Ts, therefore, whether or not the blink durations of the driver D are longer than usual can be accurately determined without being influenced by differences among individuals.

Since the rise of the drowsiness level is determined by the ratio LBR of the number of slow blinks Cs to the total number of blinks Cb within a given time, the reliability of this determination is high enough. Moreover, the determination of the rise of the drowsiness level is executed by a relatively simple processing, as mentioned before, so that the estimating apparatus can be realized with ease.

The present invention is not limited to the embodiment described above. In setting the threshold value Ts, for example, the aforesaid slicing rate (X %) and slide ratio (Y %) can be suitably set depending on the required accuracy of estimation of the drowsiness level for the estimating apparatus. Naturally, the threshold value Ts can be set by another algorithm based on the frequency distribution of blink durations. At the start of the driving operation, moreover, periods for obtaining the frequency distribution α1 of blink durations and the ratio LBR can be also suitably set in accordance with the specifications of the apparatus.

As an example of practical application, furthermore, the calculated ratio LBR may be displayed in the form of a bar graph based on a time series such that the driver D can recognize the change of the ratio LBR for a predetermined period of time.

When the rise of the drowsiness level is detected, an automatic speed reduction control for actuating the brake system of the vehicle 1 may be activated, or an automatic running mode including a recognition control of road dividing lines and a distance control for keeping the car's distance may be started. Thus, safe running of the vehicle 1 can be maintained until the driver D becomes fully awake. Further, the estimating apparatus of the invention is also applicable to passengers in the vehicle other than the driver, and can discriminate the rise of their drowsiness level in a similar manner. It is to be understood, moreover, that various changes and modifications may be effected in the present invention by one skilled in the art without departing from the scope or spirit of the invention.

What is claimed is:

1. An apparatus for estimating a drowsiness level of a driver of a vehicle, comprising:

image pickup means for picking up images of a face region of the driver including an eye of the driver;

detecting means for detecting an elapsed time during one blink of the eye as a blink duration in accordance with image data for the face region obtained by said image pickup means;

obtaining means for obtaining a frequency distribution of blink durations detected during a first predetermined period after a start of driving of the vehicle;

setting means for setting a threshold value used to extract slow blinks of the eye in accordance with the frequency distribution;

calculating means for calculating a ratio of occurrence of slow blinks during every second predetermined period after a termination of the first predetermined period, the ratio of occurrence being represented by the ratio of a number of blink durations whose values are not smaller than the threshold value to a total number of blinks of the eye during the second predetermined period; and discriminating means for discriminating the drowsiness level of the driver in accordance with the calculated ratio of occurrence.

2. The apparatus according to claim 1, wherein said setting means includes means for obtaining a normal range from the frequency distribution, means for calculating the median in the normal range, and means for outputting, as the threshold value, a value obtained by adding a predetermined time set in accordance with the normal range to the median.

3. The apparatus according to claim 2, wherein the predetermined time is defined as a value obtained by multiplying a time length of the normal range by a second predetermined ratio.

4. The apparatus according to claim 2, wherein said normal range is defined as a difference between two blink durations with a same frequency in the frequency distribution, and the same frequency is a value obtained by multiplying a mode of the frequency distribution by a first predetermined ratio.

5. The apparatus according to claim 4, wherein the predetermined time is defined as a value obtained by multiplying a time length of the normal range by a second predetermined ratio.

6. The apparatus according to claim 1, wherein said discriminating means includes a discriminating section for outputting a result of the calculation when the calculated occurrence ratio is not lower than a predetermined decision value, and alarm means for giving an alarm to the driver upon receiving the result output from the discriminating section.

7. The apparatus according to claim 1, further comprising:

display means for displaying the calculated occurrence ratio.

8. The apparatus according to claim 1, wherein said detecting means includes a storage means for successively storing the image data obtained from said image pickup means, and an image processing means for extracting the region including the driver's eye from the image data in the storage means on a time-series basis, individually specifying times at a starting of an eye blink and a termination of the eye blink from the extracted data, respectively, and detecting a time interval between the starting and the termination times as the blink duration.

9. The apparatus according to claim 1, wherein the first predetermined period is shorter than the second predetermined period.

10. An apparatus for estimating a drowsiness level of a person, comprising:

an image picking unit which picks up at least images of an eye of the person;

a detecting unit which detects an elapsed time during a single blink of the eye, as a blink duration, from the picked-up images;

an obtaining unit which obtains a frequency distribution of the blink duration during a first predetermined period of time;

a setting unit which sets a threshold value for extracting slow blinks of the eye based on the frequency distribution;

a calculating unit which calculates a ratio of occurrence of the slow blinks every second predetermined period of time after a termination of the first predetermined period of time, said ratio of occurrence being represented by a ratio of a number of blink durations whose values are not smaller than the threshold value to a total number of blinks of the eye during the second predetermined period; and a discriminating unit which discriminates the drowsiness level of the driver based on the calculated ratio of occurrence.

11. A method of estimating a drowsiness level of a person, comprising:

picking up images of an eye of the person;

detecting an elapsed time during a single blink of the eye, as a blink duration, from the picked-up images;

obtaining a frequency distribution of the blink duration during a first predetermined period of time;

setting a threshold value for extracting slow blinks of the eye based on the frequency distribution;

calculating a ratio of occurrence of the slow blinks every second predetermined period of time after a termination of the first predetermined period of time, said ratio of occurrence being represented by a ration of a number of blink durations, whose values are not smaller than the threshold value, to a total number of blinks of the eye during the second predetermined period; and discriminating the drowsiness level of the driver based on the calculated ratio of occurrence.

12. The method of claim 11, wherein said setting step includes, obtaining a normal range from the frequency distribution, calculating a median in said normal range, and outputting, as the threshold value, a value obtained by adding a predetermined time set in accordance with said normal range to said median.

13. The method of claim 11, wherein said discriminating step includes, outputting a result of said calculation when said calculated ratio of occurrence is not lower than a predetermined decision value, and outputting an alarm to the person upon receiving the result output from said discriminating section.

* * * * *